United States Patent [19]

Dien

[11] 3,931,647

[45] Jan. 13, 1976

[54] GOLF GLOVE IMPROVEMENT

[76] Inventor: Sam Dien, 156 Rockwood Place, Englewood, N.J. 07631

[22] Filed: Apr. 3, 1975

[21] Appl. No.: 564,667

[52] U.S. Cl. ..... 2/161 A
[51] Int. Cl.[2] ..... A11D 19/00
[58] Field of Search ..... 273/54 B, 166, 81.2; 2/159–161, 163

[56] References Cited

UNITED STATES PATENTS 3,707,730 1/1973 Slider ..... 2/161 A 3,880,426 4/1975 Morse ..... 273/54 B

*Primary Examiner*—Geo. V. Larkin
*Attorney, Agent, or Firm*—Hopgood, Calimafde, Kalil, Blaustein & Lieberman

[57] ABSTRACT

The thumb of a golf glove is provided with a circumferentially wrapped adjustable elongated member for confining relative thumb and thumb-stall movement.

3 Claims, 3 Drawing Figures

GOLF GLOVE IMPROVEMENT

This invention pertains to conventional golf gloves and in particular to one which eliminates a problem not heretofore generally recognized. That is, that the glove-thumb is a significant factor in generating an accurate swing and that this portion of the glove, either due to nonfit or expansion during use, permits relevant movement between the user's thumb and glove and thereby interferes with the swing accuracy.

Within the past several decades, golf gloves have become an acceptable medium for improving swing performance by permitting a more stable grip on the club handle. Although such gloves do indeed provide better performance than that achieved bare handed, I have found that a certain portion of the glove contributes significantly to the swing. That portion is the thumb area that rests on the club. Generally, right-handed players wear the glove on their left hand, which is the control hand. The left thumb supports the club to the top of the backswing. However, if the glove leather has been stretched in the thumb area or fails to fit snugly, club control is greatly diminished.

I have also found that the same is not true with the remaining fingers of the hand since these fingers are generally securely wrapped about the club. The thumb, however, merely rests on the club and stretches on each impact of the golf ball. The problem is amplified by the fact that thinner gloves create a better fit and feeling and are, therefore, used more extensively. Thinner gloves, however, have a greater propensity to stretch.

It is, therefore, an object of this invention to provide a golf glove adjunct which secures against relative movement of the thumb and glove.

It is a further object of this invention to provide adjustability of the foregoing adjunct so that during the wear-life of the glove, such adjustment will permit snugness retention.

It is a further object of this invention to accomplish the foregoing objects without material variation of the accepted conventional golf glove and to do so economically.

SUMMARY OF THE INVENTION

The above mentioned and other features and objects of this invention and the manner of attaining them will become more apparent and the invention itself will be best understood by reference to the accompanying drawings and further pointed out in the appended claims in conjunction with the following description:

Figure 1:
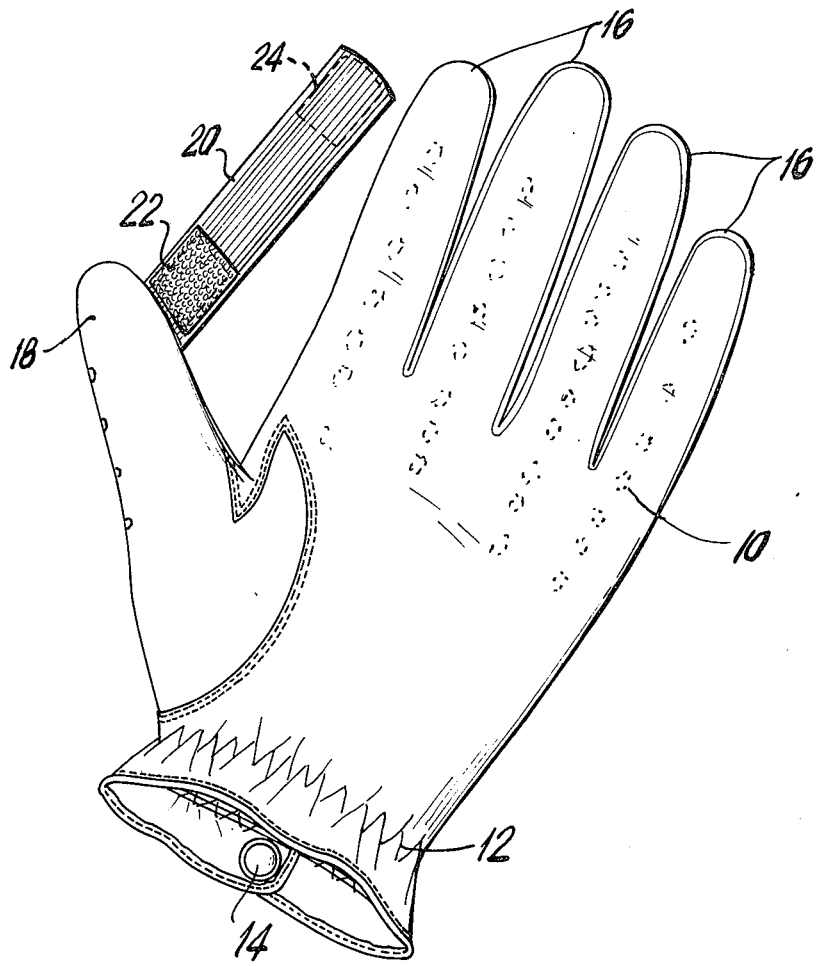
FIG. 1 illustrates a conventional golf glove with the appended improvement.

Referring now to the figures, and in particular to FIG. 1, there may be seen a conventional golf glove having the usual breathing holes 10, wrist gripping elastic 12 and securing snap 14. Preferably, although not necessarily, the glove is made of leather. Fingers 16 are conventionally formed to hug the digits of the wearer as the golf club is firmly gripped.

Thumb-stall 18 is that portion of the glove which may be conventionally ill fitting or becomes such through use because of the relative movement of the thumb-stall and the user's thumb.

Figure 2:
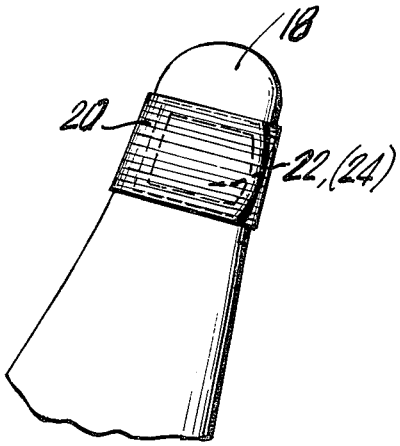
FIG. 2 is a detail of said improvement in the thumb-stall area.

As shown in greater detail in FIG. 2, thumb-stall 18 has appended thereto, at substantially right angles, an elongated web 20, preferably of elastic material. Because of the adjustability of the invention, any material including leather may also be used so long as when in its use position the engagement between thumb-stall and club provides a friction mate.

In the embodiment of the figures, web 20 has appended thereto mating VELCRO portions 22 and 24. VELCRO and its adjustable functions and the manner in which it engages may be seen in greater detail in U.S. Pat. No. 2,717,437 granted Sept. 13, 1955, to DeMestral.

For ease and permanence of attachment of web 20 to the thumb-stall, it may be simply included within the normal thumb-stall stitching 26 so as to be permanently secured thereto.

Figure 3:
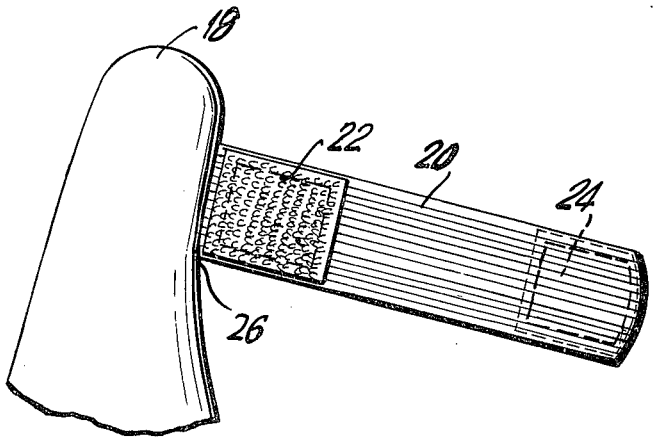
FIG. 3 is a detail of the thumb-stall area showing the improvement during use.

As may be seen from FIG. 3, the improvement to the invention is simply initiated by circumferentially wrapping web 20 about the thumb-stall so as to mate VELCRO portions 22 and 24. Naturally, these VELCRO portions should mate on the back side of the thumb-stall so as not to interfere in the thumb-stall club engagement. The natural velcro adjustability and the web flexibility, whether elastic or leather, permits sufficient variation to suit the snugness of the wearer. Needless to say, the invention does not depend on the use of VELCRO. It may alternately use any adjustable mating segments, such as hooks and eyes.

In the foregoing manner, it may be seen how the objects of this invention are easily satisified and regardless of the wear or stretch of the thumb-stall area, the snugness between the glove and the thumb of the user is maintained.

While the principles of the invention have been described in connection with specific apparatus, it is to be clearly understood that this description is made only by way of example and not as a limitation to the scope of the invention.

What is claimed is:

1. In a golf glove of conventional design, the improvement comprising an elongated webbing fixedly attached at one end to the thumb-stall substantially perpendicular thereto, said webbing including variable mating means at the opposite ends and sides thereof, wherein said webbing may be wrapped circumferentially about the thumb-stall to a degree of snugness suitable to the user.

2. The improvement claimed in claim 1 wherein said elongated webbing is elastic and is attached to the thumb-stall by means of inclusion in the thumb-stall seam.

3. The improvement claimed in claim 2 wherein said mating means comprises mating VELCRO sections.

* * * * *